United States Patent [19]

Smith

[11] 4,116,509

[45] Sep. 26, 1978

[54] MODULAR FURNITURE UNIT FOR HOSPITAL PHARMACIES OR THE LIKE

[75] Inventor: Richard C. Smith, Edina, Minn.

[73] Assignee: R. C. Smith Company, Minneapolis, Minn.

[21] Appl. No.: 702,106

[22] Filed: Jul. 2, 1976

[51] Int. Cl.[2] ..... A47B 97/00

[52] U.S. Cl. .....312/257R; 108/108; 211/187; 312/280

[58] Field of Search ..... 312/257 A, 258 SK, 249, 312/195, 280, 196, 278, 279; 211/187; 108/108, 109

[56] References Cited

U.S. PATENT DOCUMENTS

| | | | |
|---|---|---|---|
| 491,249 | 2/1893 | Reynolds | 312/196 |
| 2,678,489 | 5/1954 | Ratzlaff et al. | 312/196 X |
| 2,830,825 | 4/1958 | Webber et al. | 211/187 |
| 2,855,261 | 10/1958 | Wells et al. | 312/279 |
| 2,935,205 | 5/1960 | Higgin | 211/187 |
| 3,015,466 | 1/1962 | Levy | 211/187 |
| 3,197,265 | 7/1965 | Rand | 211/187 |
| 3,269,552 | 8/1966 | Townsend | 312/279 |
| 3,305,286 | 2/1967 | Fenwick | 211/187 |
| 3,589,310 | 6/1971 | Tucker | 108/108 |
| 3,828,937 | 8/1974 | Nash | 211/187 |

FOREIGN PATENT DOCUMENTS

| | | | |
|---|---|---|---|
| 1,196,387 | 6/1970 | United Kingdom | 312/257 SK |

*Primary Examiner*—Mervin Stein
*Assistant Examiner*—Alex Grosz
*Attorney, Agent, or Firm*—James R. Haller

[57] ABSTRACT

An easily assembled and disassembled free-standing modular furniture unit which may be particularly adapted for use in hospital pharmacies or the like. The unit comprises a lower section which includes a self-supporting, generally parallelepiped-shaped container having top and bottom walls, and an upper section. The top wall of the lower section has at least a pair of spaced holes therethrough, and the bottom wall includes upwardly exposed brackets which are vertically aligned with the top wall holes. The unit includes at least a pair of upright support posts carrying the upper section at their upper ends and extending slideably downwardly through the top wall holes in snug, supportive relationship with the holes. The bottom ends of the posts are releasably secured to the brackets. By upward removal of the posts from the holes in the lower section, the upper and lower sections may be disconnected and may be readily replaced with other furniture sections.

1 Claim, 5 Drawing Figures

FIG. 3
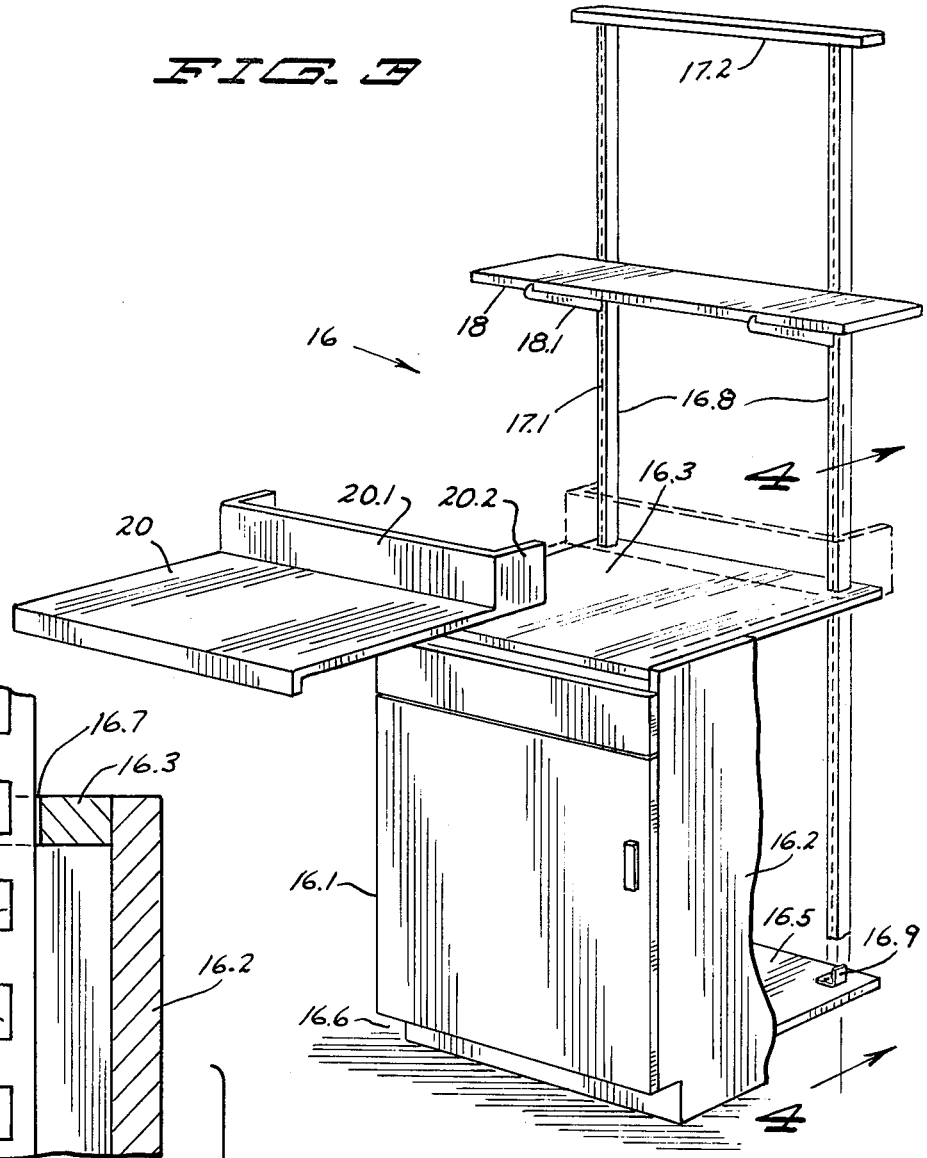
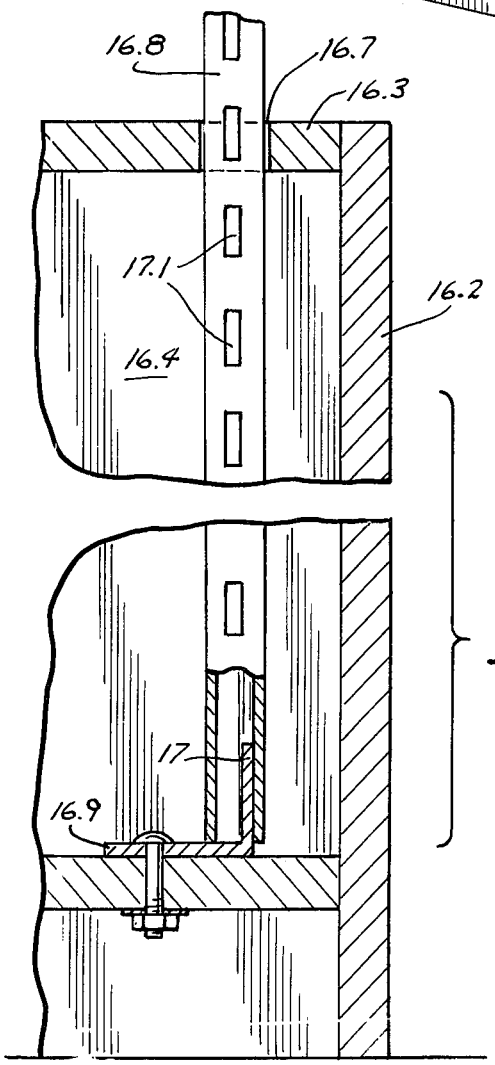
FIG. 4

MODULAR FURNITURE UNIT FOR HOSPITAL PHARMACIES OR THE LIKE

BACKGROUND OF THE INVENTION

Furniture units, such as laboratory benches and equipment storage containers of the type employed in hospital pharmacies or other laboratories, have routinely been installed on a more-or-less permanent basis. It has thus been found difficult to rearrange a laboratory or pharmacy, or to change the various furniture units to meet the changing requirements of such work place. Such removable furniture units as have become available have exhibited little versatility in that such units, if they were to be moved, had to be moved as a whole.

Because of the changing work-space requirements in many hospital pharmacies and other laboratories, there is a need for laboratory furniture which cannot only be moved readily, but which can be easily altered so that, for example, a sink unit may be easily replaced with a desk unit or cabinet unit. Yet, furniture of this type should be extremely sturdy and well made to withstand shocks or jars which could tip over delicate glassware or the like.

SUMMARY OF THE INVENTION

The present invention provides a free-standing modular furniture unit having a lower section (e.g., a cabinet) and an upper section (e.g., shelving), in which the sections may be easily separated from one another and replaced by other units, and which is of sturdy construction. The lower section includes a self-supporting, generally parallelepiped container having top and bottom walls, the top wall having at least a pair of spaced holes therethrough. The bottom wall includes a pair of upwardly exposed brackets in vertical alignment with the top wall holes. The unit includes at least a pair of upright support posts carrying the upper section at their upper ends and extending slideably downwardly through, and in snug, supportive relationship with, the top wall holes. The posts have bottom ends releasably secured to the brackets. The upper and lower sections of the unit hence may be easily disconnected simply by lifting the posts from their supportive engagement in the holes and to the brackets.

The posts may be provided at least along a portion of their lengths adjacent their upper ends with spaced slots, and the upper portion may include hooks which are engageable in the slots for support of the upper portion by the posts.

DESCRIPTION OF THE DRAWING

FIG. 1 is a perspective view showing several modular units of the invention in place along the wall of a laboratory or the like;

FIG. 3 is a perspective, exploded, partially broken away view of the unit shown in FIG. 2;

FIG. 4 is a cross-sectional, broken away view taken along line 4—4 of FIG. 3.

DETAILED DESCRIPTION

Figure 1:
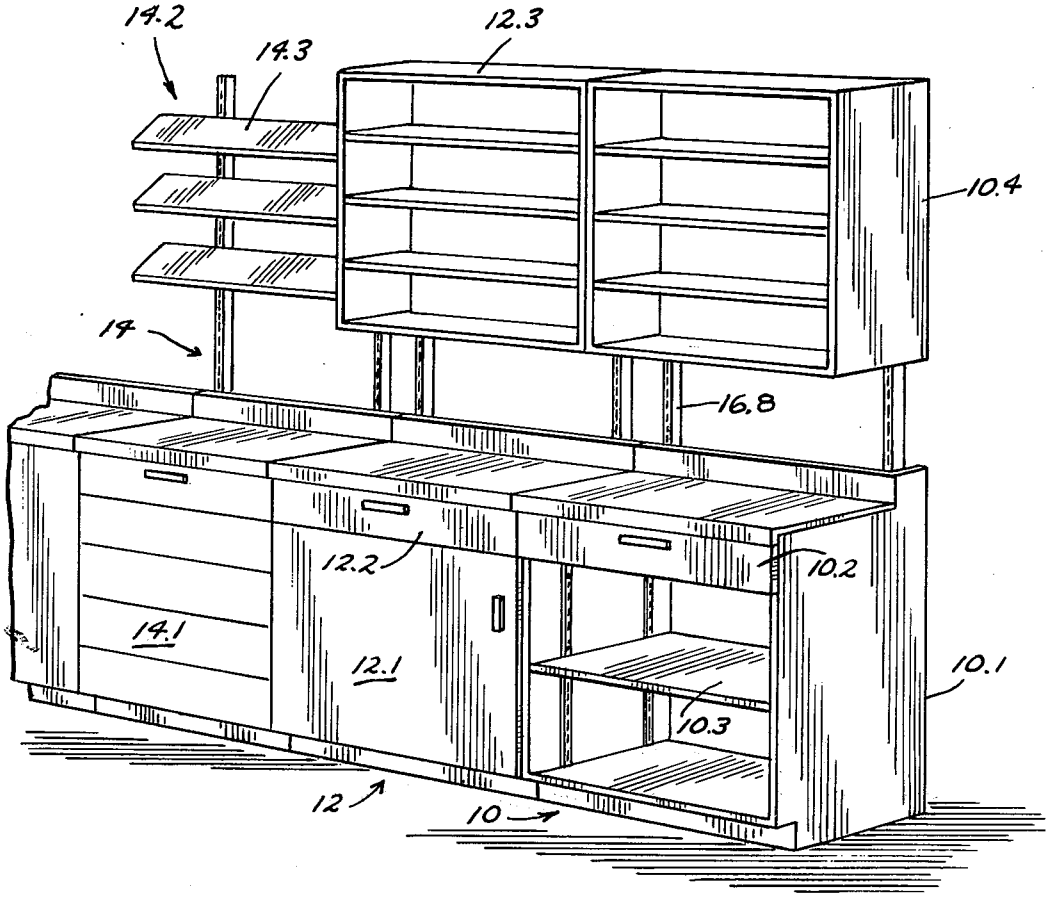

FIG. 1 depicts three modular units of the invention side by side. Each of the units includes an upper section and a lower section joined by posts. One of the modular units is designated 10 in FIG. 1, and consists of a bottom unit 10.1 having a top drawer 10.2 and shelving 10.3, and an upper, shelving unit 10.4. The second unit, designated 12, has a lower section including a cabinet with a door 12.1 and a drawer 12.2, and an upper section of shelving 12.3. The upper sections 10.4 and 12.3, as depicted, are partially enclosed. A third modular unit designated 14 includes a multidrawer bottom unit 14.1 and a top shelving unit 14.2, the latter unit having exposed shelves 14.3. FIG. 1 depicts generally the different types of upper and lower sections which can be combined into a unit of the invention, and it will be understood that a variety of other sections such as sink sections, refrigerator sections, and the like may be employed as well.

Figure 2:
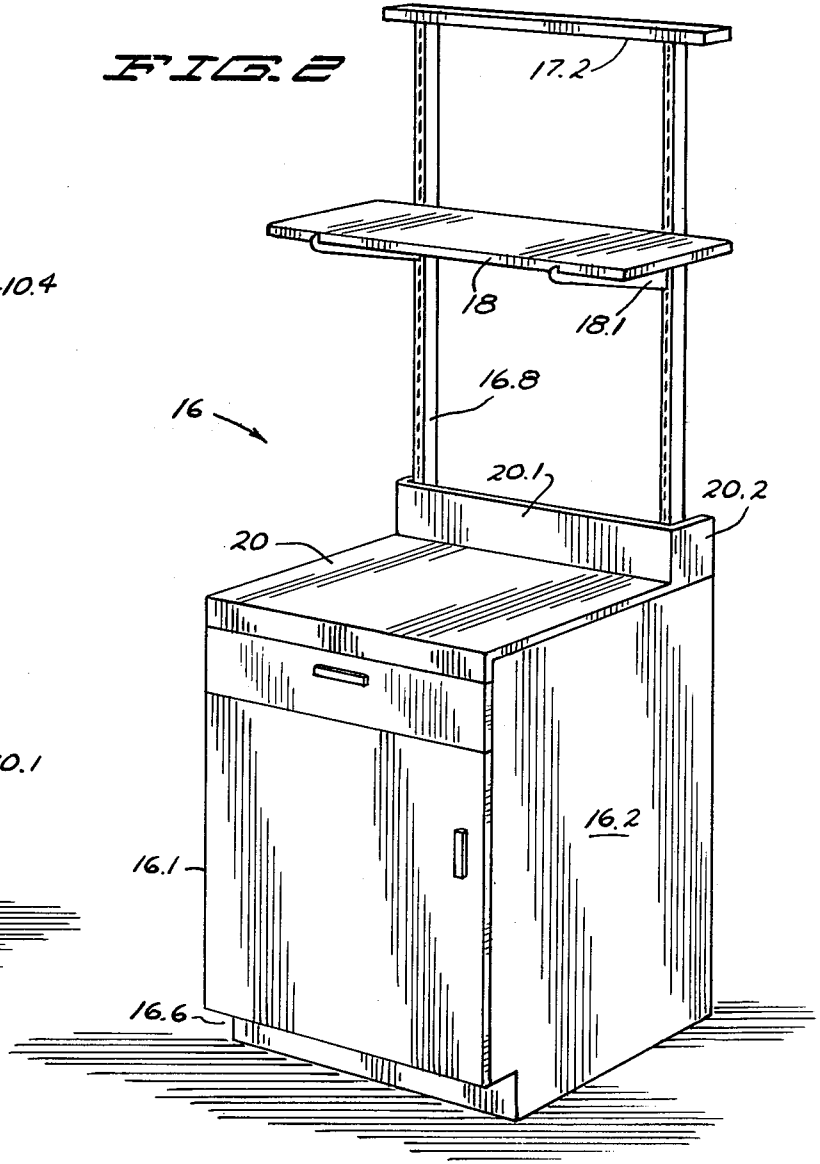
FIG. 2 is a perspective view of a modular unit of the invention.

FIGS. 2, 3 and 4 depict an exemplary furniture unit of the invention (designated 16) which includes a lower section 16.1 which is generally parallelepiped in shape and which includes side walls 16.2, a top wall 16.3, rear wall 16.4 and a bottom wall 16.5. The bottom section 16.1 is sturdy and self-supporting on a floor. The bottom wall 16.5, which may be spaced slightly above the floor upon which the unit rests, may be provided with threaded, adjustable-height legs (not shown), which can be threaded upwardly or downwardly through the bottom wall 16.5 from within the lower section. At its front, the lower section may be provided with a recessed toe space 16.6.

A pair of generally rectangular holes, designated 16.7 in FIGS. 3 and 4, are provided at the rear corners of the top wall 16.3, i.e., adjacent the side and rear edges of the top wall. Extending slideably downwardly through the respective holes 16.7 are tubular support posts 16.8 of generally rectangular cross section, the posts being in snug, supportive relationship with the holes. Brackets 16.9, of generally L-shaped cross section, are fastened by means of bolts or the like to the bottom wall 16.5 in vertical alignment with the holes 16.7, the brackets (FIG. 4) having upstanding portions 17 which are received within the hollow lower ends of the posts. The lower ends of the posts, and the upstanding portion 17 of the bracket, may be mutually configured so that the posts releasably snap onto the brackets. As will now be understood, when the posts are in position, they are supported at their lower ends rigidly by the brackets 16.9 and are further supported intermediate their heights by the holes 16.7 in the top wall 16.3.

The posts 16.8 are provided for at least a portion of their length adjacent their upper ends with spaced slots 17.1, which may face forwardly or rearwardly or both, and a downwardly open, box-like enclosure 17.2 may be provided at the upper ends of the posts for further lateral support.

The upper section of the modular furniture unit of FIGS. 2 and 3 is depicted as a shelf 18 which is supported by the posts 16.8 by means of right-angled brackets 18.1 having rearwardly and downwardly extending hooks at their rear ends which are releasably receivable in the slots 17.1 of the posts.

A countertop section 20 rests upon the top wall 16.3 (FIGS. 2 and 3), and includes an upright rear wall 20.1 having rearwardly-extending upright edges 20.2 which pass along the outer edges of the posts 16.8, the upright wall 20.1 serving, if desired, as a "splash board".

The enclosed shelf upper sections 10.4, 12.3 (FIG. 1) are provided with rearwardly and downwardly extending hooks on their rear surfaces, which hooks are appropriately spaced to be received in the posts 16.8. In this manner, the enclosed shelving 10.4, 12.3 of FIG. 1 or other upper furniture section, may be substituted for the shelf 18 of the unit shown in FIG. 3.

The lower unit 16.1 of the embodiment of FIG. 3 may be replaced with another unit merely by lifting the posts 16.8 out of their respective holes 16.7, replacing the bottom section 16.1 with another desired section, and reinserting the posts in the appropriate holes of the replacement section. In the preferred embodiment, the posts 16.8 are held in place only by the holes 16.7 and brackets 16.9, permitting the modular unit to be assembled and disassembled without the use of tools.

Figure 5:
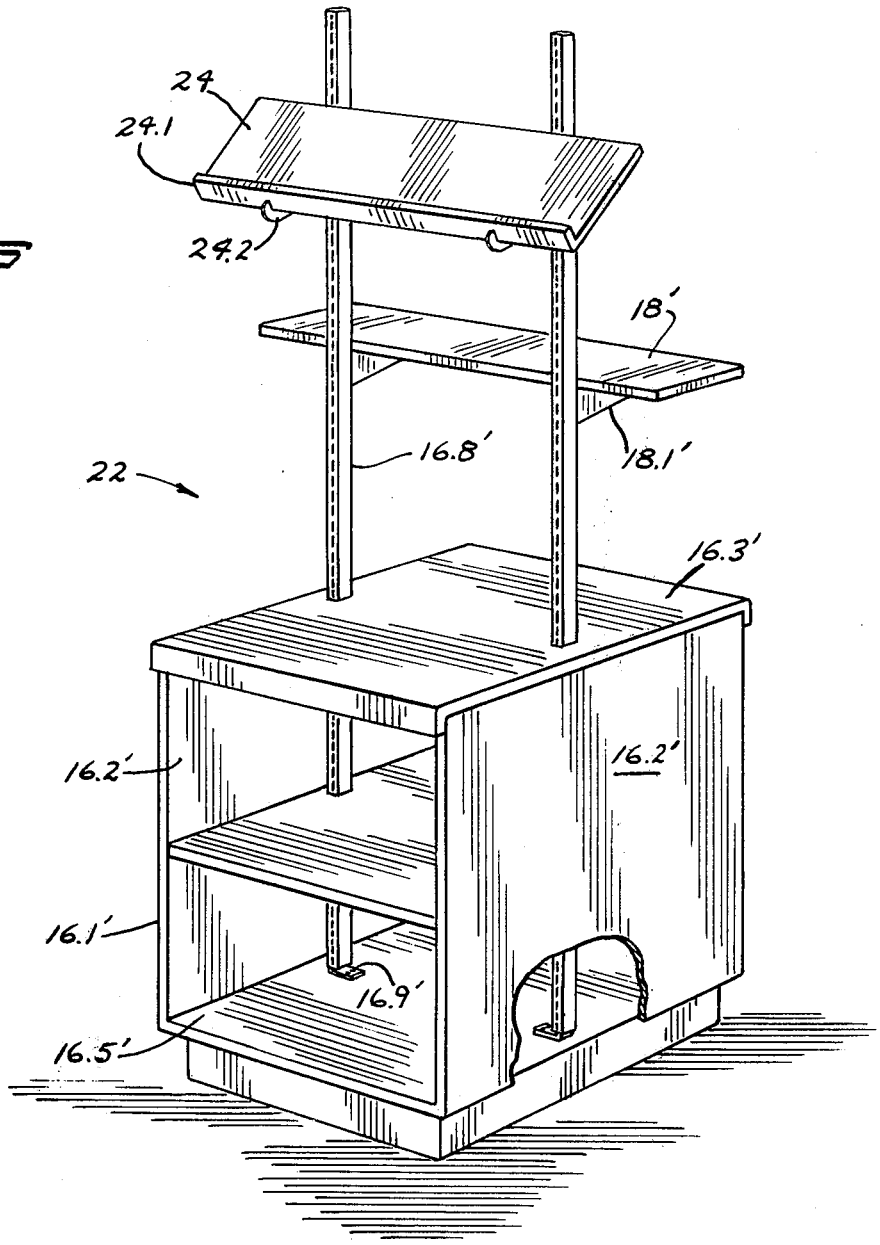
FIG. 5 is a perspective view, partially broken away, of another embodiment of a modular unit of the invention.

The modular furniture unit 22 depicted in FIG. 5 is similar to that depicted in FIGS. 2 and 3, and the same reference numerals (primed) are employed throughout. In the embodiment of FIG. 5, however, the rectangular holes extending through the top wall 16.3' adjacent its side edges are located approximately midway between its front and rear edges. The tubular posts 16.8', which similarly are generally rectangular in cross section and have forwardly and rearwardly facing slots in their forward and rearward surfaces, are attached at their lower ends to the bottom wall 16.5' by means of brackets 16.9', and extend directly upwardly through the holes in the top wall 16.3, the latter holes coming into snug, sliding and supportive relationship with the posts. An upper furniture section of shelfing 18' is mounted by means of brackets 18.1' to the rearward facing surfaces of the posts 16.8'. A forwardly and downwardly slanting shelf 24, having an upwardly turned lower lip 24.1 for holding bottles or the like, is attached to the forward facing surfaces of the posts 16.8' by means of suitable brackets 24.2 having rearwardly and downwardly extending hooks as described above. It will be understood that the embodiment of FIG. 5 may be employed as one of a series of modular units which may be positioned, for example, near the center of a laboratory and which can be approached and used both from the front and from the rear.

The posts 16.8, 16.8', as described, are supported at their lower ends by means of the brackets 16.9, 16.9' and are further supported intermediate their heights by contact with the holes 16.7 formed in the top wall 16.3, 16.3' of the lower sections of the modular units. In this manner, the posts are prevented from swaying from side to side or from front to rear, and provide a sturdy support for upper furniture sections. The holes 16.7 are spaced inwardly slightly from the side edges of the top walls of the units, and as a result the posts 16.8 are carried between the vertical planes defined by the side walls 16.2, thereby permitting the modular furniture units of the invention to be placed side by side in abutting relationship as shown in FIG. 1 to provide a continuous length of laboratory work space. Yet, not withstanding their strength, the modular units of the invention may be easily disassembled as described above. The upper removable furniture sections, which rigidly join the posts at or adjacent their upper ends, further support the posts from moving from side to side and aid in maintaining the posts parallel to one another.

While I have described a preferred embodiment of the present invention, it should be understood that various changes, adaptations, and modifications may be made therein without departing from the spirit of the invention and the scope of the appended claims.

What is claimed is:

1. Easily assembled free-standing modular furniture unit comprising a lower section including a self-supporting generally parallelepiped container having top and bottom walls, and an upper section, the lower section having at least a pair of spaced holes through its top wall and spaced inwardly from edges of the top wall, the lower section including upwardly exposed brackets carried by the bottom wall in vertical alignment with the top wall holes, the brackets having upright portions, at least a pair of upright support posts bearing at their upper ends the upper section and extending downwardly slideably through the top wall holes and in snug, supportive relationship with the holes, the posts having hollow lower ends receiving the upright bracket portions and removable upwardly therefrom and through the top wall holes, and an upwardly removable cover inserted over and joining the posts at their upper ends;

whereby the upper and lower sections may be easily assembled and disassembled by insertion and removal of the posts.

* * * * *